United States Patent [19]

Culmone et al.

[11] 4,105,574

[45] Aug. 8, 1978

[54] PROCESS FOR FORMULATING A NON-CAUSTIC OVEN CLEANER WHICH WILL REMOVE PYROLYZED FAT EFFICACIOUSLY

[75] Inventors: Vincent Culmone, Passaic; Thaddeus J. Kaniecki, Pompton Plains, both of N.J.

[73] Assignee: American Cyanamid Company, Stamford, Conn.

[21] Appl. No.: 685,037

[22] Filed: May 10, 1976

Related U.S. Application Data

[63] Continuation of Ser. No. 543,844, Jan. 24, 1975, abandoned.

[51] Int. Cl.[2] ..... B08B 3/08; C11D 3/12; C11D 3/14; C11D 3/20

[52] U.S. Cl. ..... 252/154; 134/38; 134/40; 252/89 R; 252/140; 252/153; 252/155; 252/160; 252/173; 252/DIG. 14

[58] Field of Search ..... 252/153, 154, 155, 160, 252/529, 89, 140, 173; 134/38, 40

[56] References Cited

U.S. PATENT DOCUMENTS

| | | | |
|---|---|---|---|
| 3,586,478 | 6/1971 | Neumann | 423/331 |
| 3,716,488 | 2/1973 | Kolsky | 252/155 |
| 3,865,756 | 2/1975 | Smith | 252/159 |

FOREIGN PATENT DOCUMENTS 1,275,740 5/1972 United Kingdom.

OTHER PUBLICATIONS

"Veegum — Formulary of Cosmetic and Household Products," Technical Bulletin of R.T. Vanderbilt Co. Inc., New York, May 1966.

*Primary Examiner*—Dennis L. Albrecht
*Attorney, Agent, or Firm*—Charles J. Fickey

[57] ABSTRACT

A non-caustic oven cleaner suitable for removing baked on organic matter comprising monomethanolamine; an etherified alkylene glycol solvent; a synthetic, hydrous magnesium silicate geling agent; water; and non-ionic and anionic surfactants.

2 Claims, No Drawings

PROCESS FOR FORMULATING A NON-CAUSTIC OVEN CLEANER WHICH WILL REMOVE PYROLYZED FAT EFFICACIOUSLY

This is a continuation of application Ser. No. 543,844 filed Jan. 24, 1975, now abandoned.

This invention relates to the cleaning of surfaces, such as the surfaces of ovens, which are subjected to heat and are liable to soiling by baked-on organic deposits. The soiling matter deposited on ovens, such as domestic cooking ovens, consists of a complex organic mixture of natural fats and other deposits from the cooking of food. When heated at normal oven temperatures, this soiling matter is converted into an infusible polymeric mass in which the organic material may also be charred.

Detergents, scouring powders and similar cleansing agents, are not usually adequate for removing baked-on soil of the type found in home ovens.

The removal of this type of soil is therefore a considerable problem, requiring powerful chemical or physical action. Among the most effective chemical compounds known for this purpose are the caustic alkalis, sodium and potassium hydroxides. Their mode of action is to react with and hydrolyze natural fats, converting them at least partially into their sodium or potassium salts, which are water-soluble and thus easily removed. Commercial products of this type usually contain up to 3% of sodium hydroxide together with other components such as solvents, emulsifiers, etc., which promote the efficiency of the product. They may be applied directly by brush or sponge, or more conveniently by means of an aerosol spray.

Products of the type described, although efficient in their oven cleaning ability, suffer a number of major disadvantages, the most important of which is a serious hazard to the eyes and skin arising from the use of caustic alkalis. Aside from health and safety hazards, such products must attack the soiling matter from the outer surface, while most severe charring and polymerization has generally occurred in the interior of the soil layer, adjacent to the oven wall.

Alkalis less alkaline than caustic soda, although less hazardous, are not very effective in hydrolyzing baked-on fat in the short time of application, and consequently are not efficient oven cleaners. Also, certain pretreatment preparations are known which act by forming a physical barrier between the oven wall and the soiling matter. They do not depend on chemical action. They are expensive and not very effective.

Attempts have been made to circumvent the hazardous use of caustic alkalis and provide a safe and efficient oven cleaner without resort to these materials, or by reducing the total alkalinity.

A patent issued to S. C. Johnson & Son, Inc. (British Pat. No. 1,275,740) describes an aqueous oven cleaner composition free of caustic alkalis comprising 1 to 15% of an organic amine, preferably monoethanolamine, and one or more surfactants, preferably at least one nonionic and at least one anionic surfactant.

The compositions of the patent preferably contain alkaline builders, such as ammonium, sodium and potassium phosphates, silicates, carbonates, etc.; ammonia to assist in saponification of the fats and greases; abrasives, including suspending agents therefore, such as Veegum (colloidal magnesium aluminum silicate); thickeners, such as carboxymethyl cellulose; and organic solvents, preferably glycols. The compositions are considerably less hazardous and corrosive than the highly caustic commercial oven cleaner compositions, but they are not as effective in removing the baked-on organic deposits.

Thus, there continues to be a need for an oven cleaner which exhibits the efficiency of highly alkaline caustic compositions without the hazardous properties.

It is therefore the principal object of the present invention to provide a highly efficient and efficacious oven cleaner which is relatively nontoxic and nonhazardous to the user.

The present invention is based on the discovery of an oven cleaning composition which exhibits the cleaning or soil removing properties of highly alkaline caustic compositions, is safe to use and is relatively nontoxic, comprising monoethanolamine, an etherified alkylene glycol solvent, a synthetic, hydrous sodium magnesium silicate geling agent and water.

The first essential component of the oven cleaning composition of the invention is monoethanolamine, used in an amount of from about 5% to about 15% by weight.

The second essential component is an etherified alkylene glycol solvent, which improves the cleaning action by slowing the evaporation of the monoethanolamine from the oven wall, dissolving the fats and greases which are removed, and in aiding penetration into the baked-on grease. A preferred solvent is diethylene glycol diethyl ether (diethyl Carbitol). Other suitable solvents include diethylene glycol monoethyl ether (Carbitol), diethylene glycol monobutyl ether (butyl Carbitol) and ethylene glycol monobutyl ether (butyl Cellosolve). The solvent is present in an amount of from about 5 to 15% by weight.

The third essential ingredient is a synthetic, hydrous sodium magnesium silicate geling agent (thickening agent) in an amount of from about 0.3 to 5% by weight. A particularly preferred species is a clay marketed by LaPorte Industries as Laponite CP. See U.S. Pat. No. 3,586,478. Laponite CP is a synthetic hydrous sodium magnesium silicate of the following composition: 57.4% $SiO_2$, MgO, 0.95% $Li_2O$, 2.78% $Na_2O$, 0.04% $Fe_2O_3$0.26% $Al_2O_3$, 0.05% CaO, 0.4% $SO_3$, 0.3% $CO_2$, 5% $H_2O$.

Water is, of course, essential to the efficacy of the oven cleaner composition of the invention. It has been observed that the effectiveness of the cleaner is a result of the monoethanolamine-water-solvent system migrating to the oven wall and lifting the soil as platelets, while the combination of synthetic clay and surfactants forms a stable physical foam barrier which restricts evaporation of the active ingredients. The effectiveness of the cleaning composition is believed to be due in considerable part to the effectiveness of the foam barrier in preventing evaporation of the active ingredients. Similar results are not obtained when the synthetic, hydrous sodium magnesium silicate is replaced by thickeners such as methyl cellulose or a complex colloidal magnesium aluminum silicate sold under the trademark Veegum.

Surfactants, when discharged from aerosol systems, produce foam, which sticks to the preheated ovenwalls for a length of time sufficient to allow saponification reactions between the active ingredients and grease and fat. Anionic surfactants produce the most stable foams at 200° F. Nonionic surfactants produce a wetter foam and act as propellant emulsifiers. We prefer to use a combination of at least one anionic and at least one nonionic surfactant. The preferred anionic surfactant is an ethoxylated $C_{12}$–$C_{15}$ alcohol sulfate neutralized with ammonia, sold under the trademark Neodol 25-3A. The preferred nonionic surfactant is an ethoxylated nonylphenol emulsifier containing 9 moles of ethylene oxide per mole of nonylphenol, sold under the trademark Tergitol TP-9. Other suitable anionic surfactants include sodium linear alkylate sulfonates, such as Ultrawet 45KX. Other suitable nonionic surfactants include alkylaryl polyethylene glycol ethers, such as Surfonic N95 and octylphenoxy polyethoxy ethanol, such as Triton X-100. Under certain conditions it may be desirable to use nonionics, such as addition products of ethylene diamine and propylene oxide followed by addition of ethylene oxide, for example Tetronic 1508, or condensates of propylene oxide with propylene glycol, for example Pluronic F127, to assist in suspending the synthetic, hydrous sodium magnesium silicate. The anionic surfactants is generally used in an amount of about 1 to 5% by weight; the nonionic is used in an amount of about 0.5 to 5% by weight.

The cleaning composition may also contain alkaline builders, such as ammonium, sodium or potassium phosphates, silicates, carbonates, and the like; abrasives such as high silica content minerals; conventional propellants for aerosol application; fragrances, etc.

The oven cleaning compositions of the invention are made by forming an aqueous gel from the clay, admixing monoethanolamine and organic solvent. The surfactants are added last.

The following example illustrates the invention.

A mixture of equal portions of lard, tallow and chicken fat was heated to the melt and a thin film brushed onto an enameled tray (to simulate a typical home oven surface). The film was then baked onto the tray by heating to 400° F for about 30 minutes. The resulting soiled tray is coated with a very hard varnish-like film.

The following composition was prepared.

EXAMPLE I

Example I

| | |
|---|---|
| Laponite CP (2.0%) | 40.00 (0.8% clay) |
| Diethyl Carbitol | 10.00 |
| Neodol 25-3A | 1.00 |
| Tergitol TP-9 | 0.20 |
| Monoethanolamine | 10.00 |
| Fragrance | 0.30 |
| Water | 38.50 |

The above formulation was prepared in aerosol form and sprayed onto a previously prepared enameled tray preheated to 200° F vs a commercial highly alkaline caustic oven cleaner in aerosol form. The trays were then returned to an oven, heated at 200° F, for about 15–20 minutes. On removal from the oven the tray was washed with water and the ease of soil removal and extent of soil removal observed. Both cleaners removed 90–100% of the soil readily.

In a similar experiment, the composition of Example I was compared with composition prepared in accordance with the disclosure of British Pat. No. 1,275,740 prepared as follows:

| Composition A | Parts by Weight |
|---|---|
| Veegum T (4%) | 12.00 |
| Diethyl Carbitol | 15.00 |
| Neodol 25-3A | 1.00 |
| Tergitol TP-9 | 0.20 |
| Monoethanolamine | 10.00 |

-continued

| Composition A | Parts by Weight |
|---|---|
| Water | 61.80 |

When Composition A was prepared in aerosol form and sprayed onto an enameled tray, as described above, it did not form a stable foam barrier, but instead had a tendency to run when the tray was held in a vertical position. Moreover, it tended to produce a plastic film on the enameled surface.

| Composition B | Parts by Weight |
|---|---|
| Carboxymethyl Cellulose | 50.00 |
| Diethyl Carbitol | 15.00 |
| Neodol 25-3A | 1.00 |
| Tergitol TP-9 | 0.20 |
| Monoethanolamine | 10.00 |
| Water | 23.80 |

Results obtained were similar to those with Composition A. Neither Veegum nor carboxymethyl cellulose provides a stable foam barrier similar to the Laponite CP clay.

EXAMPLE II

| | Parts by Weight |
|---|---|
| Pluronic F127 (20%) | 25.00 |
| Laponite CP (2%) | 15.00 |
| Diethyl Carbitol | 15.00 |
| Neodol 25-3A | 1.50 |
| Tergitol TP-9 | 0.30 |
| Monoethanolamine | 10.00 |
| Fragrance | 0.30 |
| Water | 32.90 |

Treated in the manner described, the composition produced a stable foam barrier and provided essentially complete removal of the baked-on oven soil.

EXAMPLE III

| | Parts by Weight |
|---|---|
| Laponite CP (2%) | 25.00 |
| Tetronic 1508 (10%) | 15.00 |
| Diethyl Carbitol | 10.00 |
| Neodol 25-3A | 1.30 |
| Tergitol TP-9 | 0.30 |
| Monoethanolamine | 10.00 |
| Fragrance | 0.30 |
| Water | 37.90 |

Results obtained were similar to Example II.

We claim:

1. A non-caustic alkaline, water-based oven cleaner composition capable of removing substantially all of baked on organic matter, said composition consisting essentially by weight, of about 0.3 to 5 percent of a synthetic, hydrous sodium magnesium silicate of the following composition: 57.4% $SiO_2$, 25.4% MgO, 0.95%$Li_2O$, 2.78% $Na_2O$, 0.04% $Fe_2O_3$, 0.26% $Al_2O_3$, 0.05% CaO, 0.4% $SO_3$, 0.3% $CO_2$, 5% $H_2O$; about 5 to 15 percent monoethanolamine, about 5 to 15 percent of an etherfied alkylene glycol solvent, about 1 to 5 percent of at least one anionic surfactant and about 0.5 to 5 percent of at least one nonionic surfactant, the balance being water, said composition being capable of forming a stable foam barrier on the surface to be cleaned, whereby there is substantially no flow of said cleaner on vertical surfaces.

2. The cleaner composition of claim 1 wherein said anionic surfactant is an ethoxylated $C_{12}$–$C_{15}$ aliphatic alcohol sulfate neutralized with ammonia and said nonionic surfactant is an ethoxylated nonyl phenol containing 9 moles of ethylene oxide per mole of nonyl phenol.

* * * * *